US006789402B2

(12) United States Patent
Okamoto

(10) Patent No.: US 6,789,402 B2
(45) Date of Patent: Sep. 14, 2004

(54) WELT-SEAMING METHOD AND WELT-SEAMED KNITTED FABRIC, AND CAD DEVICE FOR WELT-SEAMING

(75) Inventor: Kazuyoshi Okamoto, Gose (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/333,814

(22) PCT Filed: Jul. 19, 2001

(86) PCT No.: PCT/JP01/06328

§ 371 (c)(1),
(2), (4) Date: Jan. 27, 2003

(87) PCT Pub. No.: WO02/10494

PCT Pub. Date: Feb. 7, 2002

(65) Prior Publication Data

US 2003/0115912 A1 Jun. 26, 2003

(30) Foreign Application Priority Data

Jul. 28, 2000 (JP) ..... 2000-228738

(51) Int. Cl.[7] ..... D04B 7/04
(52) U.S. Cl. ..... 66/64; 66/176
(58) Field of Search ..... 66/64, 176, 69, 66/179, 172 R, 169 R, 75.1, 89, 171, 170

(56) References Cited

U.S. PATENT DOCUMENTS 4,548,057 A * 10/1985 Essig ..... 66/172 R
5,456,096 A * 10/1995 Mitsumoto et al. ..... 66/69
5,669,244 A * 9/1997 Okuno ..... 66/64
5,836,177 A * 11/1998 Okuno et al. ..... 66/64
6,070,438 A * 6/2000 Okuno et al. ..... 66/172 R
6,119,050 A * 9/2000 Okuno et al. ..... 66/64
6,571,584 B1 * 6/2003 Okayama ..... 66/64

FOREIGN PATENT DOCUMENTS

JP 2747914 2/1998
WO WO 01/04398 1/2001

* cited by examiner

*Primary Examiner*—Danny Worrell
(74) *Attorney, Agent, or Firm*—Rothwell, Figg, Ernst & Manbeck

(57) ABSTRACT

The knitting that loops of rows of binding-off loops are formed with respect to a final course of a knitted fabric, so as to be continuous from a loop in the final course, and a newly formed loop of each row of binding-off loops is laid over a loop next to the loop in the final course, to form a double loop is repeated from one end of a binding-off region toward the other end thereof, to prevent loosening of loops in the final course, wherein n number of rows of binding-off loops (11, 12) are formed, starting from a plurality of loops (2, 5) in the final course in the binding-off region, and wherein when loops of the rows of binding-off loops are laid over loops in the final course in the process of the binding-off process, the loops (3, 6) of the rows of the binding-off loops are laid over loops (4, 7) in the final course located n-th wale forward of the loops, respectively, with respect to the binding-off proceeding direction.

6 Claims, 6 Drawing Sheets

WELT-SEAMING METHOD AND WELT-SEAMED KNITTED FABRIC, AND CAD DEVICE FOR WELT-SEAMING

TECHNICAL FIELD

The present invention relates to a binding-off process to prevent loosening of loops at an edge of a fabric knitted by a knitting machine on the flat knitting machine comprising at least a pair of front and back needle beds having a number of knitting needles fitted in needle grooves. The present invention also relates to a knitted fabric thus bound off and to a CAD device used for the binding off process.

BACKGROUND ART

A binding-off process for preventing loosening of loops in the final course (final row of needle loops) at an end of a fabric knitted by a flat knitting machine is known. In the binding-off process, a loop in the final course of the knitted fabric is laid over the next to form a double loop and a loop of the next course is formed at the double loop. This knitting is repeated from one end of the fabric to the other end thereof to clear the loops of the final course of the knitted fabric from the needles in sequence. When a two-layered fabric comprising front and back parts is knitted in overlapping relation in back and front and also the loops in the final course are bound off by using the front and back needle beds, the both fabrics are joined together at an end thereof on the side on which the knitting is finished. For example, when this binding-off process is used to join together front and back bodies of a sweater along a shoulder line, the need of a sewing process after the knitting can be eliminated.

The applicant previously made the proposals for the binding-off process to prevent loosening of loops while joining together two fabrics knitted in overlapping relation in back and front, like front and back bodies of a sweater, in Japanese Laid-open (Unexamined) Patent Publications No. Hei 8 (1996)-337946. Japanese Laid-open (Unexamined) Patent Publication No. 8 (1996)-337946 discloses the binding-off process wherein after a loop of a front knitted fabric and a loop of a back knitted fabric, placed opposite, are each transferred to the needles on the opposite needle beds for a while, the loop of the back knitted fabric is laid over the loop of the front knitted fabric to form a double loop and then a binding-off loop continuous to the double loop is formed. This knitting is repeatedly performed to bind off the loops of the front and back knitted fabrics. In this binding-off process, a single row of binding-off loops are formed along the joints of the front and back knitted fabrics. It is to be noted that the terminology of "row of binding-off loops" used in this specification is intended to mean a chain stitch formed in the binding-off process.

In the binding-off process of Japanese Laid-open (Unexamined) Patent Publication No. Hei 8 (1996)-337946, only a single row of binding-off loops are formed and the number of loops in the single row of binding-off loops formed in the binding-off process is identical with the number of wale in the binding-off region.

The present invention relates to a binding-off process to prevent loosening of loops at an edge of a fabric knitted and discloses a novel binding-off process that can reinforce a binding-off section and also can suppress elongation of the binding-off section; a bound off fabric; and a CAD device for binding off process.

DISCLOSURE OF THE INVENTION

For providing further improvements, the present invention provides a binding-off process which is performed by using a flat knitting machine comprising (i) at least a pair of first and second needle beds, which have a number of needles, respectively, and are placed opposite in front and back, between which a needle bed gap is defined, and at least either of which is movable slidably transversely, and (ii) at least one yarn feeder for feeding a yarn to the needles of the first needle bed and the second needle bed, and in which the knitting that loops of rows of binding-off loops are formed with respect to a final course of a knitted fabric, so as to be continuous from a loop in the final course, and a newly formed loop of each row of binding-off loops is laid over a loop next to the loop in the final course, to form a double loop is repeated from one end of a binding-off region toward the other end thereof, to prevent loosening of loops in the final course, wherein n number of rows of binding-off loops are formed, starting from a plurality of loops in the final course in the binding-off region, and wherein when loops of the rows of binding-off loops are laid over loops in the final course in the process of the binding-off process, the loops of the rows of the binding-off loops are laid over loops in the final course located n-th wale forward of the loops, respectively, with respect to the binding-off proceeding direction. According to this construction of the present invention, the rows of binding-off loops are formed, starting from a plurality of loops in the final course in the binding-off region, and the knitting that a loop of each row of binding-off loops is laid over a loop in the final course located n-th wale forward of the loop with respect to the binding-off proceeding direction is repeatedly performed to form n number of rows of binding-off loops. The rows of binding-off loops may be formed in parallel with each other or may be formed in sequence in such a manner that after any one of rows of binding-off loops is formed sequentially to the end, the other row of binding-off loops is formed. This binding-off process can provide a plurality of rows of binding-off loops for the binding-off section and, as a result of this, the binding-off region can be reinforced and the elongation can be suppressed. Further, lengths of the rows of binding-off loops can be freely adjusted by adjusting the number of rows of binding-off loops formed, length of the loop formed, and the number of times to knit the row of binding-off loops formed in the binding-off process.

In the binding-off process mentioned above, the knitted fabric to be bound off may be a two-layered fabric comprising a first knitted fabric knitted in the state of being associated with the first needle bed and a second knitted fabric knitted in the state of being associated with the second needle bed, the first and second knitted fabrics being knitted in an overlapped relation in front and back, and the loops in the final course of the first knitted fabric are retained on the second needle bed and the loops in the final course of the second knitted fabric are retained on the first needle bed, followed by transference of a loop in the final course of either of the first knitted fabric and the second knitted fabric to the opposed needle bed so that the loop in the final course of the first knitted fabric and the loop in the final course of the second knitted fabric can be overlapped with each other. According to this construction of the present invention, the loops in the final course of either of the first knitted fabric and the second knitted fabric are twisted before they are laid over the loops of the other knitted fabric and, as a result of this, the first and second knitted fabrics can be joined together without the binding-off section being projected.

Also, the present invention provides a knitted fabric knitted and bound off by using a flat knitting machine comprising (i) at least a pair of first and second needle beds, which have a number of needles, respectively, and are placed opposite in front and back, between which a needle bed gap is defined, and at least either of which is movable slidably transversely, and (ii) at least one yarn feeder for feeding a yarn to the needles of the first needle bed and the second needle bed, wherein a plurality of rows of binding-off loops are formed, starting from loops in the final course, and loops of the rows of the binding-off loops are laid over loops in the final course located at least two wale away therefrom, respectively.

In the knitted fabric, it is preferable that each row of binding-off loops is formed by a smaller number of binding-off loops than the number of wale in the final course.

Further, the present invention provides a CAD device used for a binding-off process which is performed by using a flat knitting machine comprising (i) at least a pair of first and second needle beds, which have a number of needles, respectively, and are placed opposite in front and back, between which a needle bed gap is defined, and at least either of which is movable slidably transversely, and (ii) at least one yarn feeder for feeding a yarn to the needles of the first needle bed and the second needle bed, and in which the knitting that loops of rows of binding-off loops are formed with respect to a final course of a knitted fabric, so as to be continuous from a loop in the final course, and a newly formed loop of each row of binding-off loops is laid over a loop next to the loop in the final course, to form a double loop is repeated from one end of a binding-off region toward the other end thereof, to prevent loosening of loops in the final course, the CAD device executing the knitting that n number of rows of binding-off loops are formed, starting from a plurality of loops in the final course in the binding-off region, and that when loops of the rows of binding-off loops are laid over loops in the final course in the process of the binding-off process, the loops of the rows of the binding-off loops are laid over loops in the final course located n-th wale forward of the loops, respectively, with respect to the binding-off proceeding direction.

BEST MODE FOR CARRYING OUT THE INVENTION

An example of the present invention will be described below with reference to the accompanying drawing figures: 1 showing knitting courses; 2 showing loops; and 3. A binding-off process of a final course of a plain knit is taken as an example. FIG. 2 shows the loops in the rest of the final course only. Alphabetical letters represent needles on which loops were retained in the course 0 of FIG. 1. In the following, the binding-off process of the invention will be explained with an example wherein a two-bed flat knitting machine comprising a pair of front and back needle beds confronting each other across a needle bed gap and having a number of needles arranged on tops thereof, the back needle bed being formed to be movable laterally relative to the front needle bed, is used in the condition in which all needles are used to knit a fabric, without any empty needles for loop transfer being arranged between needles for loop forming. The binding-off process of the invention may be practically worked by using a four-bed flat knitting machine having a pair of upper front and back needle beds which are arranged over the lower needle beds and on which loop transfer members are arrange in the same pitch as the lower needle beds. Also, when the two-bed flat knitting machine is used, a half gauge knitting may be selected in which front and back knitted fabrics are knitted with alternate needles or with odd needles and even needles, respectively, so that when the front knitted fabric is knitted, the loops of the back knitted fabric can all be retained by the needles of the back needle bed, while on the other hand, when the back knitted fabric is knitted, the loops of the front knitted fabric can all be retained by the needles of the front needle bed. In this half gauge knitting, since the front knitted fabric is associated with the front needle bed and the back knitted fabric is associated with the back needle bed, the empty needles for loop transfer can always be reserved on the opposed needle beds. This can allow the front knitted fabric and the back knitted fabric to be knitted in the form of front stitches and back stitches. The half gauge knitting may be combined with the racking operation of the front and back needle beds to provide the lateral shift.

Figure 1:
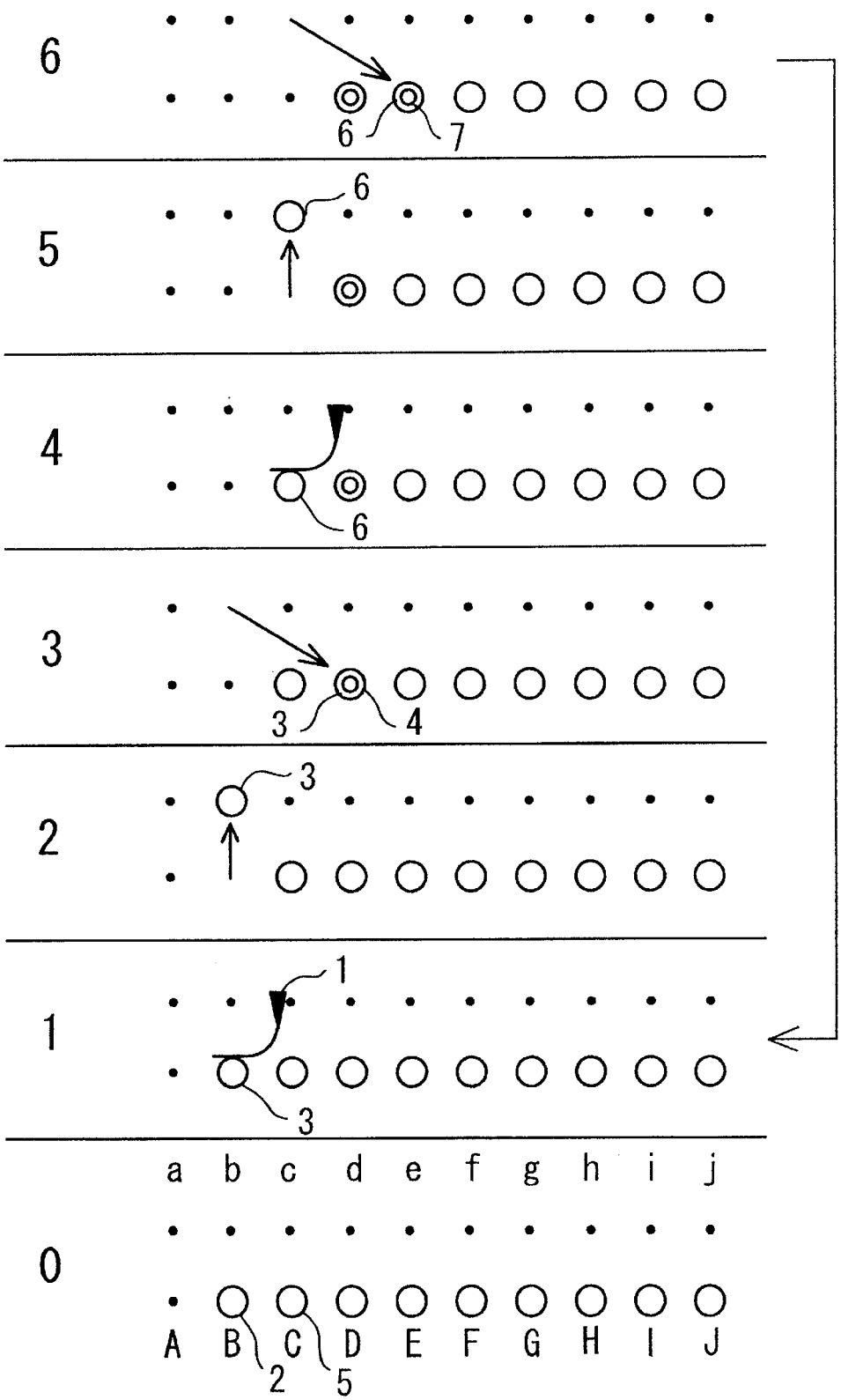
FIG. 1 shows a knitting course of a first embodiment.
Figure 2:
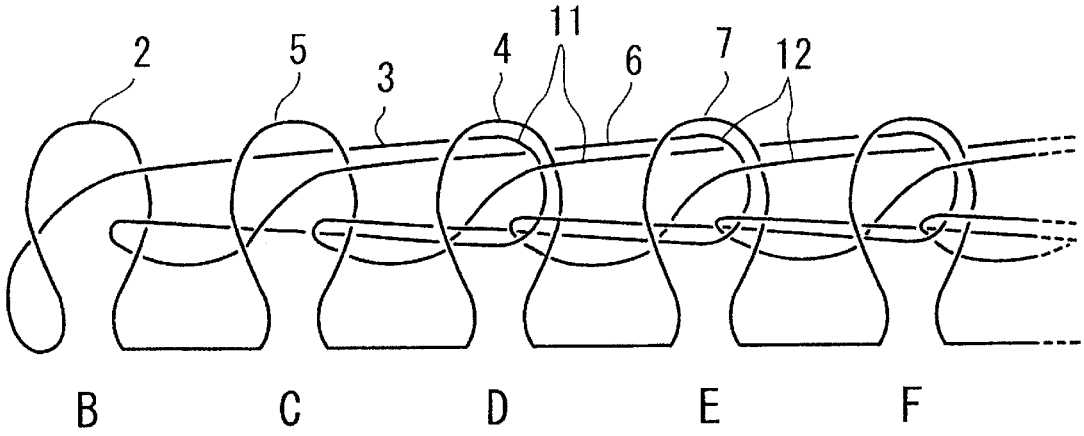
FIG. 2 shows loops in a knitted fabric bound off in the binding-off process of the first embodiment.

The course 0 of FIG. 1 shows the state before the start of the binding-off process. The loops of the final course of a plain knitted fabric are retained by the needles B–J of the course 0. The loops retained by the needles B–J are bound off from the left end toward the right end. This direction of the loops being bound off from left to right is defined as "the binding-off proceeding direction" in the following description. In the course 1, a loop 3 of a first row of binding-off loops is formed by feeding a yarn to the needle B of the front needle bed via a yarn feeder 1, starting from a loop 2 located at a side end of a binding-off region. In the next course 2, the loop 3 is transferred to the needle b of the back needle bed. In the course 3, after the yarn feeder 1 is moved to a location not to cause an obstruction of the knitting, the loop 3 is transferred to the needle D of the front needle bed and laid over a loop 4 of the final course located two wale forward of the loop 2 with respect to the binding-off proceeding direction. In the course 4, a loop 6 of a second row of binding-off loops is formed by feeding the yarn to the needle C of the front needle bed, starting from a loop 5 of the final course. In the course 5, the loop 6 is transferred to a needle c of the back needle bed. In the course 6, the loop 6 is transferred to a needle E of the front needle bed and laid over a loop 7 of the final course located two wale forward of the loop 6 with respect to the binding-off proceeding direction. Subsequently, the loop to be knitted in each of the courses 1–6 is transferred forward with respect to the binding-off proceeding direction and the newly formed loop of each row of binding-off loops is laid over a loop of the final course to form a double loop. Then, the yarn is fed to that double loop, to form a loop of the next course. This knitting is repeatedly performed to bind off the loops in the final course sequentially.

Figure 3:
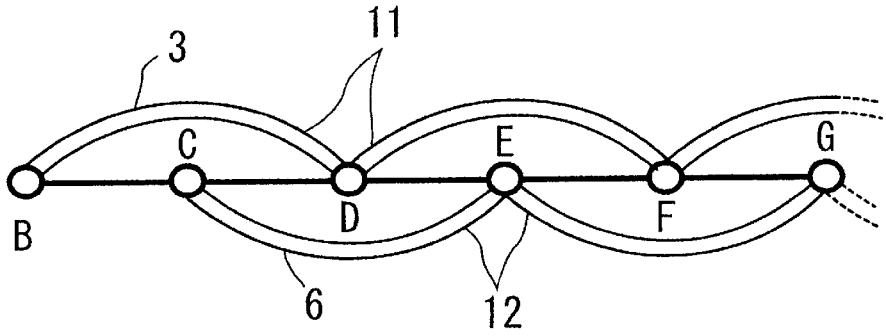
FIG. 3 shows knitting of the first embodiment.

As shown in FIGS. 2 and 3, the two rows of binding-off loops, comprising the first row of binding-off loops 11 which is formed in such a manner that a loop formed with every other needle B, D, F, . . . is laid over the next and the second row of binding-off loops 12 which is formed in such a manner that a loop formed with every other needle C, E, G, . . . is laid over the next, are formed in the knitted fabric bound off in the bonding-off process of the first embodiment.

These two rows of the binding-off loops are formed in parallel and also the number of loops in each row of binding-off loops is reduced to half as many as the number of wale in the binding-off region, as compared with the binding-off process wherein the number of binding-off loops are formed to be identical with the number of wale in the binding-off region. In this embodiment, since the two rows of binding-off loops are formed, the binding-off section can be reinforced, as compared with the binding-off process where only a single row of binding-off loops is formed.

Figure 4:
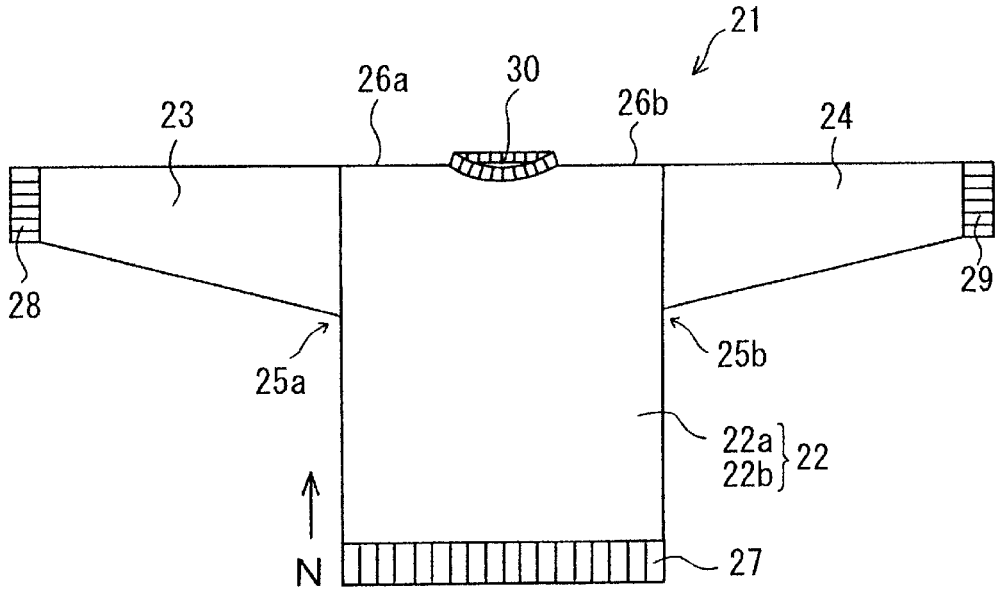
FIG. 4 shows a sweater bound off at its shoulder portion in accordance with a second embodiment.

Now, reference will be made of the second embodiment with reference to FIGS. 4–7, taking the process of binding off a shoulder portion of a sweater 21 of FIG. 4 as an example. FIG. 4 shows the finished state of the sweater 21 to be knitted. The sweater 21 comprises a tubular body 22 comprising a front body 22*a* and a back body 22*b* which are knitted in an overlapped manner in front and back and connected to each other at both ends thereof, and left and right tubular sleeves 23, 24 joined to the tubular body 22 from underarms 25*a*, 25*b* to shoulders 26*ta*, 26*b*. The knitting of the body 22 starts at its hem 27 and the knitting of the sleeves 23, 24 start at their cuffs 28, 29, and the body 22 and the left and right sleeves 23, 24 are each knitted in a tubular form up to underarms 25, separately. The sleeves 23, 24 and the body 22 are joined together at the underarms 25 by knitting the body 22 in the state in which the loops in the final course of each sleeve 23, 24 are overlapped with the loops of the body 22 at their side ends. After completion of the joining of the sleeves 23, 24 to the body 22, the front body 22*a* and the back body 22*b* are joined together at the shoulder 26 in the binding-off process. As the knitting processes before the start of the binding-off process of the shoulder portions 26*a*, 26*b* are already known, the binding-off process from the point at which the joining of the left and right sleeves 23, 24 to the body 22 is ended and the binding-off process of the shoulder 26 starts will be described in this embodiment. Also, although the left and right shoulder portions 26*a*, 26*b* sandwiching a collar opening 30 therebetween are both bound off in the actual knitting, only the knitting of the right shoulder portion 26*a* of the sweater to be bound off is described, for convenience of explanation. In this embodiment, the binding-off process starts from an end of the shoulder toward the collar opening 30.

Figure 5:
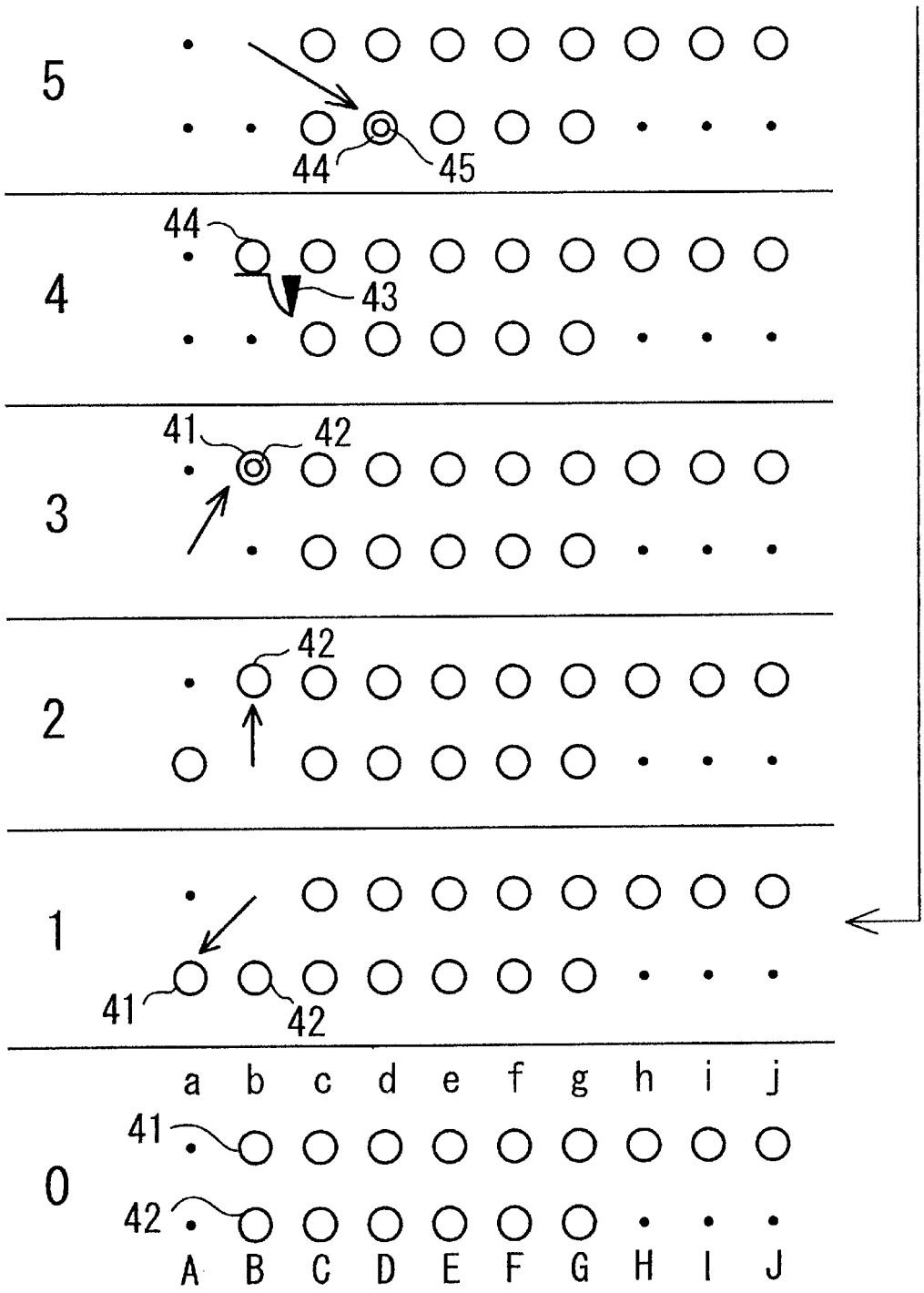
FIG. 5 shows a knitting course of the second embodiment.
Figure 6:
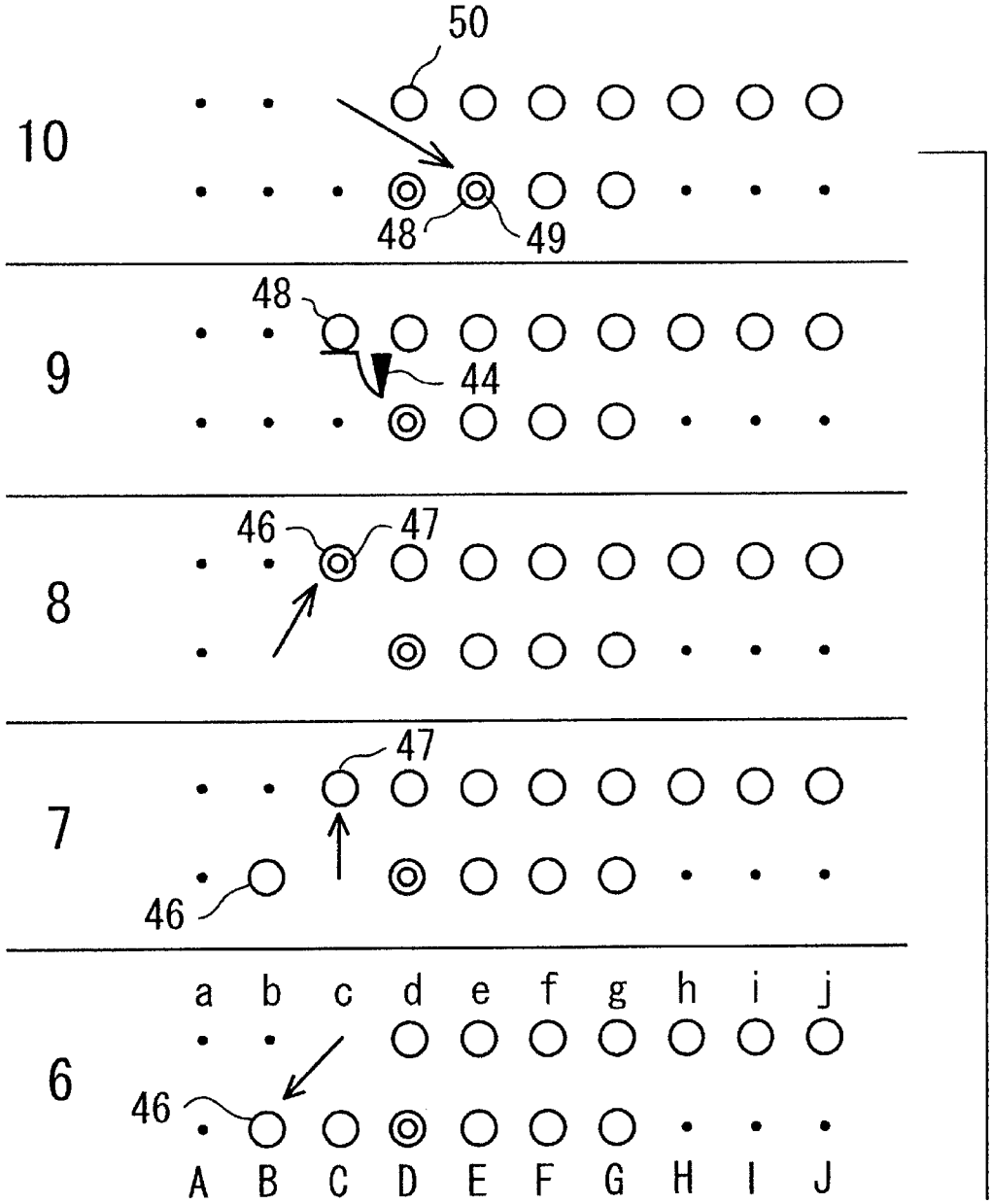
FIG. 6 shows a knitting course of the second embodiment.

In the course 0 of FIG. 5, the loops of a front shoulder portion of the front body 22*a*, which is formed into the right shoulder portion 26*a* in the sequent binding-off process, are retained by the needles B–G of the front needle bed and the loops of a back shoulder portion of the back body 22*b* are retained by the needles b–j of the back needle bed. An end of the shoulder is located on the left-hand side as viewed in FIG. 5 and the needles H–J of the front needle bed are for the collar opening 30. In the course 1, a loop 41 located at a side end of the back shoulder portion is transferred to a position outside of a loop 42 located at a side end of the front shoulder portion retained by the needle B of the front needle bed. In the course 2, the loop 42 at the side end of the front shoulder portion is transferred to the needle b of the back needle bed which turned to an empty needle. In the course 3, the loop 41 located at the side end of the back shoulder portion is transferred back to the needle b of the back needle bed and laid over the loop 42 at the side end of the front shoulder portion to form a double loop. In the course 4, a loop 44 of a first row of binding-off loops is formed by feeding a yarn to the needle b via a yarn feeder 43, starting from the double loop formed by the loops at the side ends of the front and back shoulder points. In the course 5, after the yarn feeder 43 is moved to a location not to cause an obstruction of the knitting, the newly formed loop 44 is transferred to the needle D of the front needle bed and laid over a loop 45 of the front shoulder portion. In the course 6, a loop 46 retained by the needle c located forward of the loop 41 transferred in the course 1 with respect to the binding-off process proceeding direction is transferred to the needle B of the front needle bed. In the course 7, a loop 47 retained by the needle C of the front needle bed is transferred to the empty needle c of the back needle bed. In the course 8, the loop 46 of the beck shoulder portion as was transferred to the needle B of the front needle bed is transferred to the needle c and is laid over the loop 47 of the front shoulder portion to form a double loop thereat. In the course 9, a loop 48 of a second row of binding-off loops is formed by feeding the yarn to the needle c via the yarn feeder 44, starting from that double loop. In the course 10, after the yarn feeder 44 is moved, the newly formed loop 48 is transferred to the needle E of the front needle bed and laid over a loop 49 of the binding-off loops in the final course. Subsequently, this knitting is repeatedly performed until the loops are all bound off, while the loops to be knitted in each of the courses 1–10 are sequentially transferred forward with respect to the binding-off proceeding direction.

Figure 7:
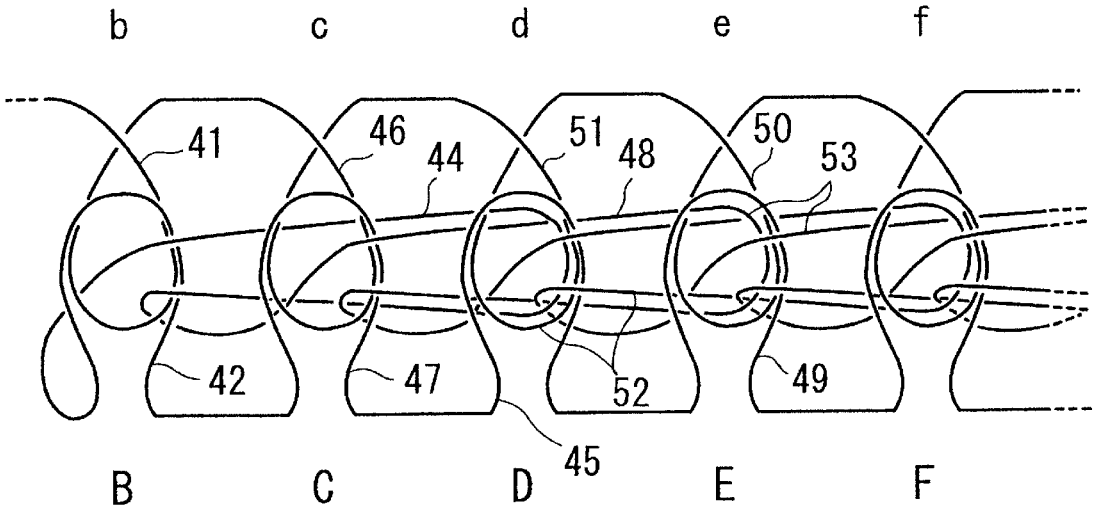
FIG. 7 shows loops in a knitted fabric bound off in the binding-off process of the second embodiment.

The knitted fabric bound off in the binding-off process of the second embodiment is shown in FIG. 7. The newly formed loop 44 on the double loop, which is formed from the loop 42 retained by the needle B and the loop 41 retained by the needle b in the course 0, is laid over the loops 45, 51 retained by the needles D and d, respectively. Likewise, the newly formed loop 48 on the double loop, which is formed from the loops 46, 47 retained by the needles C and c, respectively, is laid over the loops 49, 50 retained by the needles E and e, respectively. In the knitted fabric subjected to the binding-off process of the second embodiment, two rows of binding-off loops are formed, comprising a first row of binding-off loops 52 which is formed by laying a loop formed with every other needle B b, D d, F f, . . . over the next and a second row of binding-off loops 53 which is formed by laying a loop formed with every other needle C c, E e, G g, . . . over the next. The first row of binding-off loops 52 and the second row of binding-off loops 53 are both formed to have the number of loops half of the number of wale in the binding-off region. In the second embodiment, the loops in the final course of the front shoulder portion are retained on the back needle bed and the loops in the final course of the back shoulder portion are retained on the first needle bed, followed by transference of a loop in the final course of the front shoulder portion to the opposed needle bed so that the loop in the final course of the front shoulder portion and the loop in the final course of the back shoulder portion can be overlapped with each other. As a result of this, the loops in the final course of the back shoulder portion are twisted before they are laid over the loops of the front shoulder portion. As a result of this, the binding-off section can be prevented from being projected. In addition, since the loops 44, 48 of the row of binding-off loops go into hiding under the loops of the other row of binding-off loops and the loops in the final course 51, 52, 50, 49, the loops of the rows of binding-off loops different in orientation of wale from each other are prevented from coming out to the front side of the knitted fabric. As a result of this, a good-looking line of loops can be formed. As the details on the reason that the binding-off section is prevented from being projected and on the reason that the loops of the row of binding-off loops go into hiding under the knitted fabric are discussed in Japanese Laid-open (Unexamined) Patent Publication No. Hei 8(1996)-337946, the description thereon is omitted herein. As mentioned above, in the second embodiment, two rows of binding-off loops are formed and accordingly the number of loops in each row of binding-off loops is reduced to half, as compared with the binding-off process wherein the number of binding-off loops in each row of binding-off loops are formed to be identical with the number of wale in the binding-off region. Hence, even when a line of bonding-off loops extends horizontally, like the sweater 21 of FIG. 4, so that there is no course difference between the loops in the final course connected by the loops of the rows of binding-off loops, the loops of the rows of binding-off loops can be prevented from becoming larger than the space between the adjoining loops of the final course by increasing the number of loops in the row of binding-off loops. As a result of this, the row of binding-off loops can be prevented from being loosened to make the binding-off section odd-shaped.

As mentioned above, according to the present invention, length of the row of binding-off loops can be freely adjusted by adjusting the number of rows of binding-off loops formed, length of the loop formed, and the number of times to knit the row of binding-off loops formed in the binding-off process. For example, as the number of rows of binding-off loops increase, the reinforcement of the binding-off section increase. When the number of times to knit the row of binding-off loops formed in the binding-off process is reduced to reduce the number of loops of the row of binding-off loops, the knitted fabric whose knitting width is shrunk in the binding-off section can be knitted. Although the embodiments have been described above, taking the binding-off process for the section where the line of binding-off loops extends horizontally as an example, the binding-off process of the present invention may be applied to other sections as well, without limited to the section where the line of binding-off loops extending horizontally. Also, although the binding-off process wherein two rows of binding-off loops are formed has been described in the embodiments above, three or more rows of binding-off loops may be formed, depending on the material quality of the knitting yarn used for the knitting and on the stitch quality or density of the loop formed. Supposing that the loops in the row of binding-off loops and the loops in the final course are overlapped with each other in the proportion of one to one, the number of loops per row of binding-off loops can be reduced by increasing the number of rows of binding-off loops. In the case where three rows of binding-off loops are formed, a loop in the row of binding-off loops is laid over a loop in the final course located three wale forward of that loop with respect to the binding-off proceeding direction. In the case where four rows of binding-off loops are formed, a loop in the row of binding-off loops is laid over a loop in the final course located four wale forward of that loop. Also, although the embodiments wherein whenever one loop of the row of binding-off loops is formed, the one loop is laid over a loop in the final course have been described above, whenever two or more loops of the row of binding-off loops are formed, those two loops may be laid over loops in the final course. In addition, a plurality of yarn feeders may be used in the binding-off process so that the individual rows of binding-off loops can be formed by their respective yarn feeders. Further, although the first row of binding-off loops and the second row of binding off loops are formed in parallel in the embodiments mentioned above, one of the first and second rows of binding-off loops may be formed, first, and, then, the other of the first and second rows of binding-off loops may be formed. Furthermore, the binding-off proceeding direction may be reversed so that for example the first row of binding-off loops may be formed sequentially in the rightward direction from the left end of the binding-off region to the right end thereof, first, and, then, the second row of binding-off loops may be formed sequentially in the leftward direction from the right end of the binding-off region to the left end thereof.

The binding-off process mentioned above is carried out by knitting commands stored in a disc and the like being read by a computer built in the flat knitting machine. The computer of the flat knitting machine interprets the knitting commands and drives mechanisms of the flat knitting machine in a controllably manner. The principal knitting processes including the bonding-off process are stored in the form of subroutines in a CAD device for designing a knitted fabric. This type of CAD device includes the computer and output equipment so that the knitting commands can be written on the disc and the like. The CAD device stores the principal knitting commands in the form of subroutines. The subroutines associated with respective parts of the fabric designed by a user are properly combined with each other, followed by the output of the knitting commands. The knitting commands include the command for the flat knitting machine having the computer built-in to knit the fabric in accordance with the knitting commands. The flat knitting machine is driven under control of the built-in computer, while also the knitting commands stored in the disc and the like are read by the built-in computer and are interpreted by the CAD device, to reproduce a design picture of the fabric designed on the CAD device by the user.

Capabilities of Exploitation in Industry

According to the present invention, since a plurality of rows of binding-off loops are formed in the binding-off section, the binding-off section is reinforced to prevent elongation. Further, length of the row of binding-off loops can be freely adjusted by adjusting the number of rows of binding-off loops formed, the length of the loop formed, and the number of times to knit the row of binding-off loops formed in the binding-off process.

What is claimed is:

1. A binding-off process which is performed by using a flat knitting machine comprising (I) at least a pair of first and second needle beds, which have a number of needles, respectively, and are placed opposite in front and back, between which a needle bed gap is defined, and at least either of which is movable slidably transversely, and (ii) at least one yarn feeder for feeding a yarn to the needles of the first needle bed and the second needle bed, and in which the knitting that loops of rows of binding-off loops are formed with respect to a final course of a knitted fabric, so as to be continuous from a loop in the final course, and a newly formed loop of each row of binding-off loops is laid over a loop next to the loop in the final course, to form a double loop is repeated from one end of a binding-off region toward the other end thereof, to prevent loosening of loops in the final course, wherein at least two rows of binding-off loops are formed, starting from a plurality of loops in the final course in the binding-off region, and wherein when loops of the rows of binding-off loops are laid over loops in the final course in the process of the binding-off process, the loops of the rows of the binding-off loops are laid over loops in the final course located at least two wales forward of the loops, respectively, with respect to the binding-off proceeding direction.

2. The binding-off process according to claim 1, wherein the knitted fabric to be bound off is a two-layered fabric comprising a first knitted fabric knitted in the state of being associated with the first needle bed and a second knitted fabric knitted in the state of being associated with the second needle bed, the first and second knitted fabrics being knitted in an overlapped relation in front and back, wherein the loops in the final course of the first knitted fabric are retained on the second needle bed and the loops in the final course of the second knitted fabric are retained on the first needle bed, followed by transference of a loop in the final course of either of the first knitted fabric and the second knitted fabric to the opposed needle bed so that the loop in the final course of the first knitted fabric and the loop in the final course of the second knitted fabric can be overlapped with each other.

3. A knitted fabric knitted and bound off by using a flat knitting machine comprising (I) at least a pair of first and second needle beds, which have a number of needles, respectively, and are placed opposite in front and back, between which a needle bed gap is defined, and at least either of which is movable slidably transversely, and (ii) at least one yarn feeder for feeding a yarn to the needles of the first needle bed and the second needle bed, wherein a plurality of rows of binding-off loops are formed, starting from loops in the final course, and loops of the rows of the binding-off loops are laid over loops in the final course located at least two wale away therefrom, respectively.

4. The knitted fabric according to claim 3, wherein each row of binding-off loops is formed by a smaller number of binding-off loops than the number of wale in the final course.

5. A CAD device used for a binding-off process which is performed by using a flat knitting machine comprising (I) at least a pair of first and second needle beds, which have a number of needles, respectively, and are placed opposite in front and back, between which a needle bed gap is defined, and at least either of which is movable slidably transversely, and (ii) at least one yarn feeder for feeding a yarn to the needles of the first needle bed and the second needle bed, and in which the knitting that loops of rows of binding-off loops are formed with respect to a final course of a knitted fabric, so as to be continuous from a loop in the final course, and a newly formed loop of each row of binding-off loops is laid over a loop next to the loop in the final course, to form a double loop is repeated from one end of a binding-off region toward the other end thereof, to prevent loosening of loops in the final course, the CAD device generating knitting commands:

that at least two rows of binding-off loops are formed, starting from a plurality of loops in the final course in the binding-off region, and that when loops of the rows of binding-off loops are laid over loops in the final course in the process of the binding-off process, the loops of the rows of the binding-off loops are laid over loops in the final course located at least two wales forward of the loops, respectively, with respect to the binding-off proceeding direction.

6. A knitted fabric knitted and bound off by using a flat knitting machine comprising (I) at least a pair of first and second needle beds, which have a number of needles, respectively, and are placed opposite in front and back, between which a needle bed gap is defined, and at least either of which is movable slidably transversely, and (ii) at least one yarn feeder for feeding a yarn to the needles of the first needle bed and the second needle bed, and in which the knitting that loops of rows of binding-off loops are formed with respect to a final course of a knitted fabric, so as to be continuous from a loop in the final course, and a newly formed loop of each row of binding-off loops is laid over a loop next to the loop in the final course, to form a double loop is repeated from one end of a binding-off region toward the other end thereof, to prevent loosening of loops in the final course, wherein at least two rows of binding-off loops are formed, starting from a plurality of loops in the final course in the binding-off region, wherein when loops of the rows of binding-off loops are laid over loops in the final course in the process of the binding-off process, the loops of the rows of the binding-off loops are laid over loops in the final course located at least two wales forward of the loops, respectively, with respect to the binding-off proceeding direction, and wherein each row of binding-off loops is formed by a smaller number of binding-off loops than the number of wale in the final course.

* * * * *